US008342528B2

(12) United States Patent
Porto

(10) Patent No.: US 8,342,528 B2
(45) Date of Patent: Jan. 1, 2013

(54) PROPOSITION WAGERING CARD GAME AND METHOD OF PLAY

(76) Inventor: Michael Guy Porto, Bronx, NY (US)

( * ) Notice: Subject to any disclaimer, the term of this patent is extended or adjusted under 35 U.S.C. 154(b) by 381 days.

(21) Appl. No.: 12/267,038

(22) Filed: Nov. 7, 2008

(65) Prior Publication Data

US 2009/0124318 A1 May 14, 2009

Related U.S. Application Data

(60) Provisional application No. 61/002,554, filed on Nov. 13, 2007.

(51) Int. Cl.
*A63F 1/00* (2006.01)

(52) U.S. Cl. ..... 273/292; 463/13

(58) Field of Classification Search ..... 273/292
See application file for complete search history.

(56) References Cited

U.S. PATENT DOCUMENTS

2004/0164492 A1 * 8/2004 Crenshaw et al. ..... 273/292

* cited by examiner

*Primary Examiner* — Michael Dennis
(74) *Attorney, Agent, or Firm* — Scully, Scott, Murphy & Presser, P.C.

(57) ABSTRACT

A new card game and method of play is provided. The card game includes a means for making at least one proposition related to the value of a single card to be revealed from a 36-card deck of cards and a means for representing the deck of thirty-six cards. The deck of thirty-six cards includes (a) one card of a first value, (b) two cards of a second value, (c) three cards of a third value, (d) four cards of a fourth value, (e) five cards of a fifth value, (f) six cards of a sixth value, (g) five cards of a seventh value, (h) four cards of an eighth value, (i) three cards of a ninth value, (j) two cards of a tenth value, and (k) one card of an eleventh value.

11 Claims, 9 Drawing Sheets

PROPOSITION WAGERING CARD GAME AND METHOD OF PLAY

CROSS-REFERENCE TO RELATED APPLICATIONS

This application claims the benefit of provisional patent application 61/002,554 filed Nov. 13, 2007, the contents of which are incorporated herein by reference.

FIELD OF THE INVENTION

The present invention relates generally to gaming systems, more particularly, to proposition wagering card game systems and methods.

BACKGROUND OF THE INVENTION

Card games have been known as forms of gambling and entertainment for centuries. Casinos as well as other entertainment providers are always looking to introduce new games to consumers.

While consumers are familiar with casino games such as poker, blackjack, and roulette, there is a certain degree of complexity involved in playing such games. Therefore, there is a need for a new game of chance that will appeal to all levels of expertise in game playing and gambling.

SUMMARY OF THE INVENTION

A system for playing a card game is provided. The system for playing the card game comprises a representation of a deck of thirty-six cards comprising (a) one card of a first value, (b) two cards of a second value, (c) three cards of a third value, (d) four cards of a fourth value, (e) five cards of a fifth value, (f) six cards of a sixth value, (g) five cards of a seventh value, (h) four cards of an eighth value, (i) three cards of a ninth value, (j) two cards of a tenth value, and (k) one card of an eleventh value, a layout for indicating at least one proposition related to the value of a single card to be revealed from the representation of the deck of thirty-six cards, a means of indicating, with reference to the layout, at least one proposition related to the value of a single card to be revealed from the representation of the deck of thirty-six cards. A proposition is one of that the value of the single card to be revealed from the representation of the deck of thirty-six cards is of a value as indicated by the proposition indicating means, that the value of the single card to be revealed from the representation of the deck of thirty-six cards is of a value of one of either the first or eleventh value, either the second or tenth value, either the third or ninth value, either the fourth or eighth value, and either the fifth or seventh value, as indicated by the proposition indicating means; and that the value of the single card to be revealed from the representation of the deck of thirty-six cards is of a value ranking lower than the sixth value or ranking higher than the sixth value, as indicated by the proposition indicating means, the first to fifth values having a lower rank than the sixth value and the seventh to eleventh values having a higher rank than the sixth value.

A method for playing a game is also provided. The method for playing the game comprises accepting at least one proposition related to the value of a single card to be revealed from a representation of a deck of thirty-six cards, the representation of a deck of thirty-six cards comprising: (a) one card of a first value, (b) two cards of a second value, (c) three cards of a third value, (d) four cards of a fourth value, (e) five cards of a fifth value, (f) six cards of a sixth value, (g) five cards of a seventh value, (h) four cards of an eighth value, (i) three cards of a ninth value, (j) two cards of a tenth value, and (k) one card of an eleventh value, randomly selecting a single card to be revealed from the representation of the deck of thirty-six cards, and determining whether any of the at least one accepted proposition relates to the value of the single card revealed from the representation of the deck of thirty-six cards. A proposition is one of that a value indicated by the accepted proposition is the same as the value of the single card revealed from the representation of the deck of thirty-six cards, that the single card revealed from the representation of the deck of thirty-six cards has a value that is one of either the first or eleventh value, either the second or tenth value, either the third or ninth value, either the fourth or eighth value, and either the fifth or seventh value, as indicated by the accepted proposition, and that the value of the single card revealed from the representation of the deck of thirty-six cards is one of a value ranking lower than the sixth value or ranking higher than the sixth value, as indicated by the accepted proposition, wherein the first to fifth values are assigned a lower rank than the sixth value and the seventh to eleventh values are assigned a higher rank than the sixth value.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION

As used herein, a "card" can be a physical elongate paper or plastic item with one or more indicia imparted thereon, or it can be a virtual card, which is defined herein as any representation of a playing card that may look identical to the indicia (face) side of a physical card. Virtual cards are used in conjunction with a computer, or similar digital processing means, which will display the virtual card on a video display monitor or other display devices.

Figure 1A:
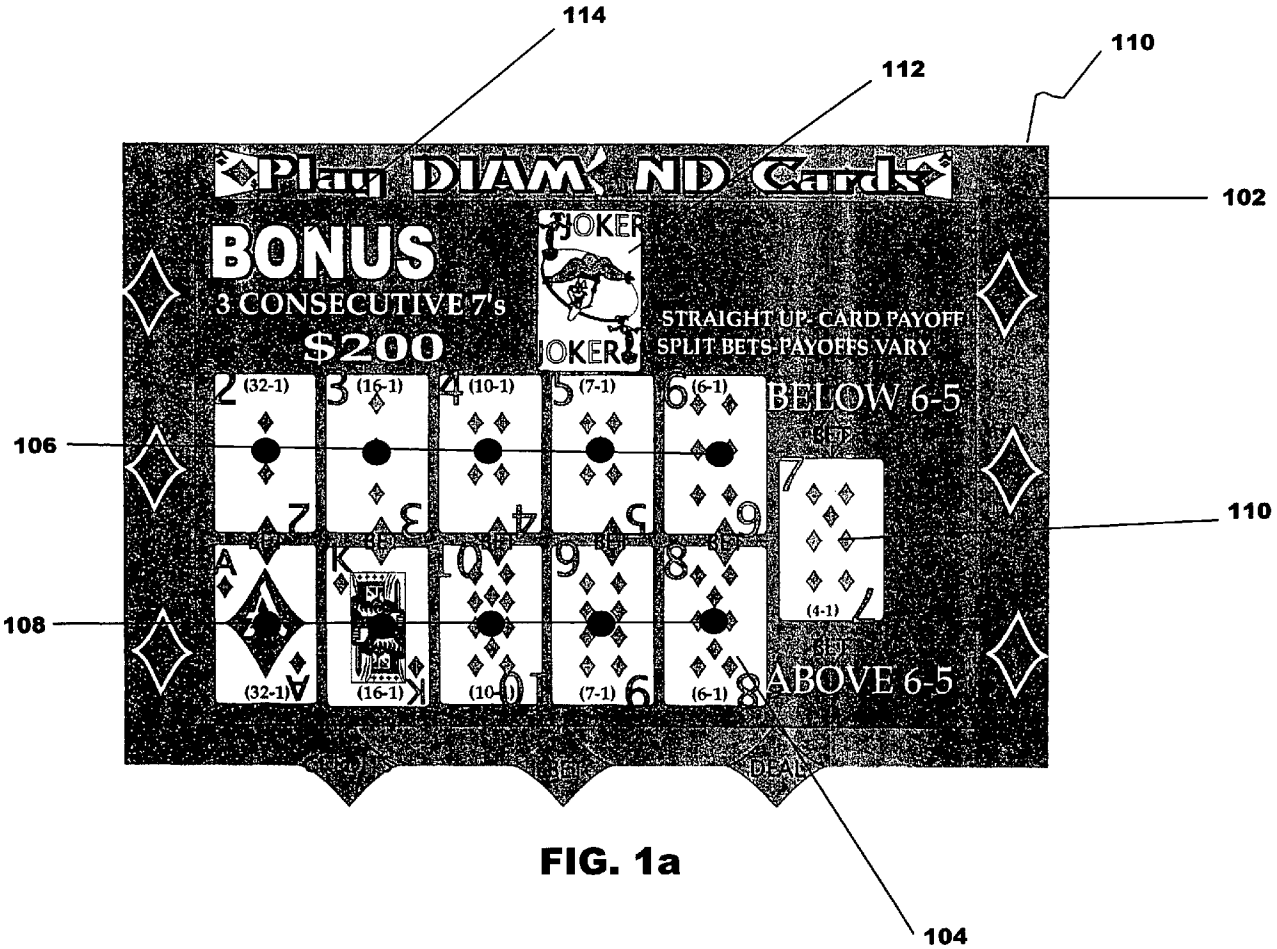
FIGS. 1*a* and 1*b* illustrate a card game system according to a first embodiment.
Figure 1B:
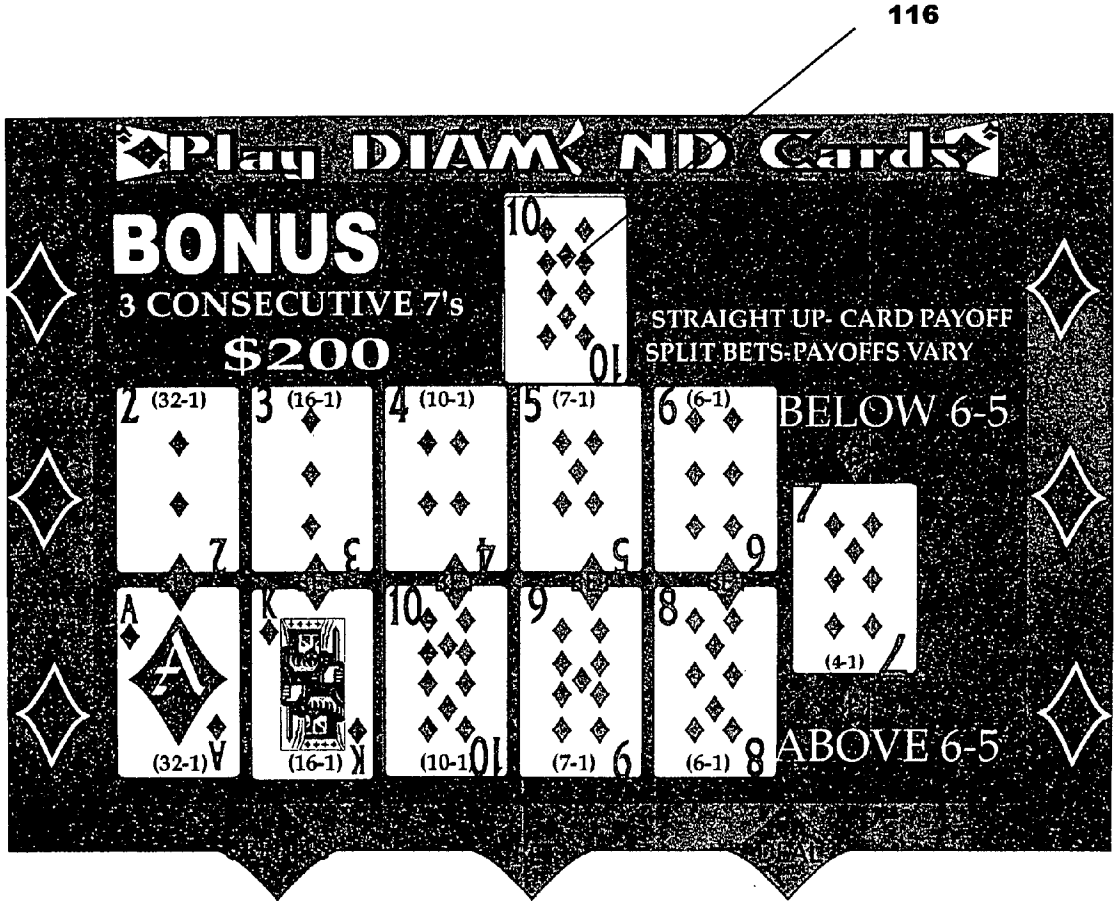

Referring now to FIGS. 1*a* and 1*b*, a first embodiment in the form of a card game system is shown herein, the card game system being referred to generally by reference numeral 100. The card game system 100 has a game surface 102 that is fabricated from conventional materials known in the art, such as felt. The same surface 102 also has indicia 104 printed, silk-screened or the like thereon. The indicia displays available wagering propositions as will be described below. The card game system 100 also includes at least one deck of cards as will be described below.

According to the first embodiment, each of the at least one deck of cards is a 36-card deck of cards. The 36-card deck of cards includes (a) one card of a first value/rank, (b) two cards of a second value/rank, (c) three cards of a third value/rank, (d) four cards of a fourth value/rank, (e) five cards of a fifth value/rank, (f) six cards of a sixth value/rank, (g) five cards of a seventh value/rank, (h) four cards of an eighth value/rank, (i) three cards of a ninth value/rank, (j) two cards of a tenth value/rank, and (k) one card of a eleventh value/rank.

Figure 2:
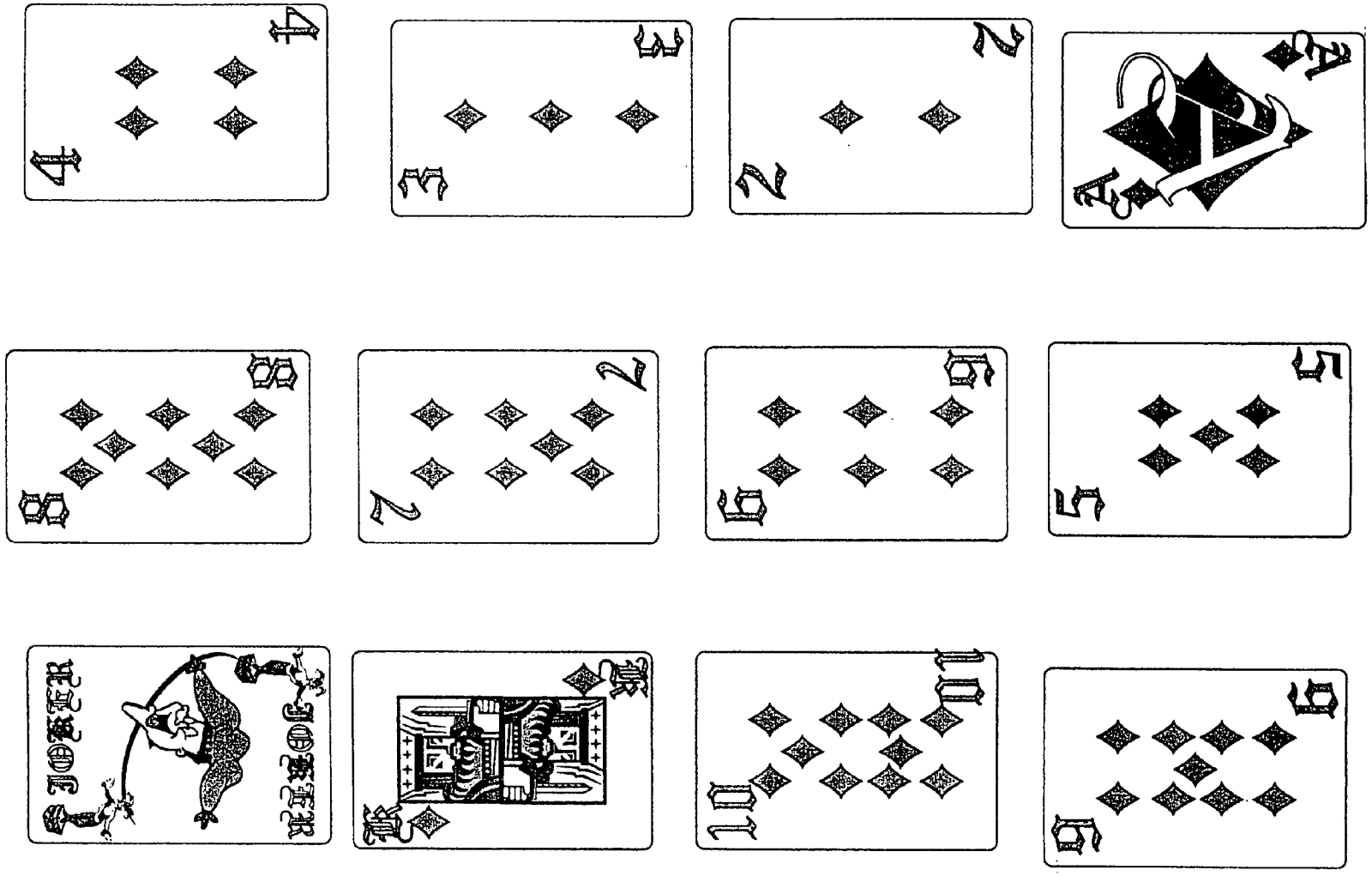
FIG. 2 illustrates the value/rank of card available in an exemplary deck of cards.

FIG. 2 illustrates the value/rank of cards in an exemplary deck of cards. A 36-card deck of cards includes, for example, one "Ace" card, two "King" cards, three "Ten" cards, four "Nine" cards, five "Eight" cards, six "Seven" cards, five "Six" cards, four "Five" cards, three "Four" cards, two "Three" cards, and one "Two" card, where the value/rank of the cards are similar to that found in a standard 52-card deck of playing cards.

The cards in the 36-card deck can include additional indicia such as one of the four traditional card suits, i.e., hearts, diamonds, spades, and clubs. For example, each card in the above-described 36-card deck can be of a diamonds suit. The cards in the 36-card deck can also be of a combination of suits.

It is preferable to use a randomization device of some kind such that one or more cards can be randomly revealed from the deck of thirty-six cards. The card game system 100 according to the first embodiment may include, for example, a random card shuffler (not shown). Such randomization devices are also trivial to program using any computer language that provides random numbers.

Referring back to FIGS. 1*a* and 1*b*, the game surface 102 includes indicia 104 provided thereon for the placement of proposition wagers. As an example, the game surface 102 in FIG. 1 shows two rows of indicia, a first row 106 having indicia representing cards having a "Two", "Three", "Four", "Five" and "Six" value/rank from left to right, and a second row 108 having indicia representing cards having a "Ace", "King", "Ten", "Nine" and "Eight" value/rank from left to right. The game surface 102 further includes an indicium 110 of a "Seven" card to the right of the first 106 and second row 108 of indicia. The game surface 102 still further includes an area 112 for revealing the value/rank of winning card randomly drawn from the above-described 36-card deck of cards. On game surface 102, the area 112 for revealing the winning card is marked by a "Joker" card indicium.

Play of the card game involves one or more players each placing one or more proposition wagers on the game surface 102. Available proposition wagers include different types of inside and outside bets.

Inside bets include:

- a straight-up bet that is a wager that a randomly revealed card from the 36-card deck has a predetermined rank indicated by a player on the game surface 102, where the wager is made by placing, for example, one or more chips (as an indicating means) directly on a desired card rank/value indicium 104 of the game surface 102;
- a split bet that is a wager that a randomly revealed card from the 36-card deck has a predetermined rank indicated by a player on the game surface 102, where the wager is made by placing, for example, one or more chips on two adjoining card rank/value indicia 104 (for example, placing chips in between the "Two" and "Ace" card indicia).

Outside bets include a row bet that is a wager that a randomly revealed card from the 36-card deck has a predetermined rank that is one from either the first row 106 of indicia (i.e., a card rank of "two", "Three", "Four", "Five" or "Six") or the second row 108 (i.e., "Ace", "King", "Ten", "Nine", or "Eight"), where the wager is made by placing one or more chips to the right of either the first 106 or second row 108 of indicia, respectively.

In addition to above-described proposition wagering options, the game surface 102 can provide an additional indicium/area 114 for placing a bonus bet that is a wager that each of a single randomly revealed card from three 36-card decks will have a single predetermined rank/value. As illustrated in FIGS. 1*a* and 1*b*, the bonus bet is a wager that a "Seven" card will be revealed in each of three 36-card deck.

The payoff for a winning proposition wager may be indicated on the game surface 102. As an example, the payoff for straight-up bets are indicated on the card indicia 104. As seen in FIGS. 1*a* and 1*b*, the payoff for straight-up bets are stated as N-to-1, meaning that a winning straight-up proposition wager wins the listed award plus the return of the original wager. Payoffs may vary according to a predetermined payoff schedule established by the casino providing the game.

Tables 1-3, below, provide exemplary payoff schedules.

TABLE 1

STRAIGHT-UP BET PAYOFF SCHEDULE

| Straight-up Bet | Payoff |
|---|---|
| "Two" card | 32-1 |
| "Ace" card | 32-1 |
| "Three" card | 16-1 |
| "King" card | 16-1 |
| "Four" card | 10-1 |
| "Ten" card | 10-1 |
| "Five" card | 7-1 |
| "Nine" card | 7-1 |
| "Six" card | 6-1 |
| "Eight" card | 6-1 |
| "Seven" card | 4-1 |

TABLE 2

SPLIT BET PAYOFF SCHEDULE

| Split Bet | Payoff |
|---|---|
| "Two" over "Ace" | 16-1 |
| "Three" over "King" | 7-1 |
| "Four" over "Ten" | 4-1 |
| "Five" over "Nine" | 3-1 |
| "Six" over "Eight" | 2-1 |

TABLE 3

OUTSIDE BET PAYOFF SCHEDULE

| Outside Bet | Payoff |
|---|---|
| Above "Seven" bet | 6-5 |
| Below "Seven" bet | 6-5 |

Figure 3:
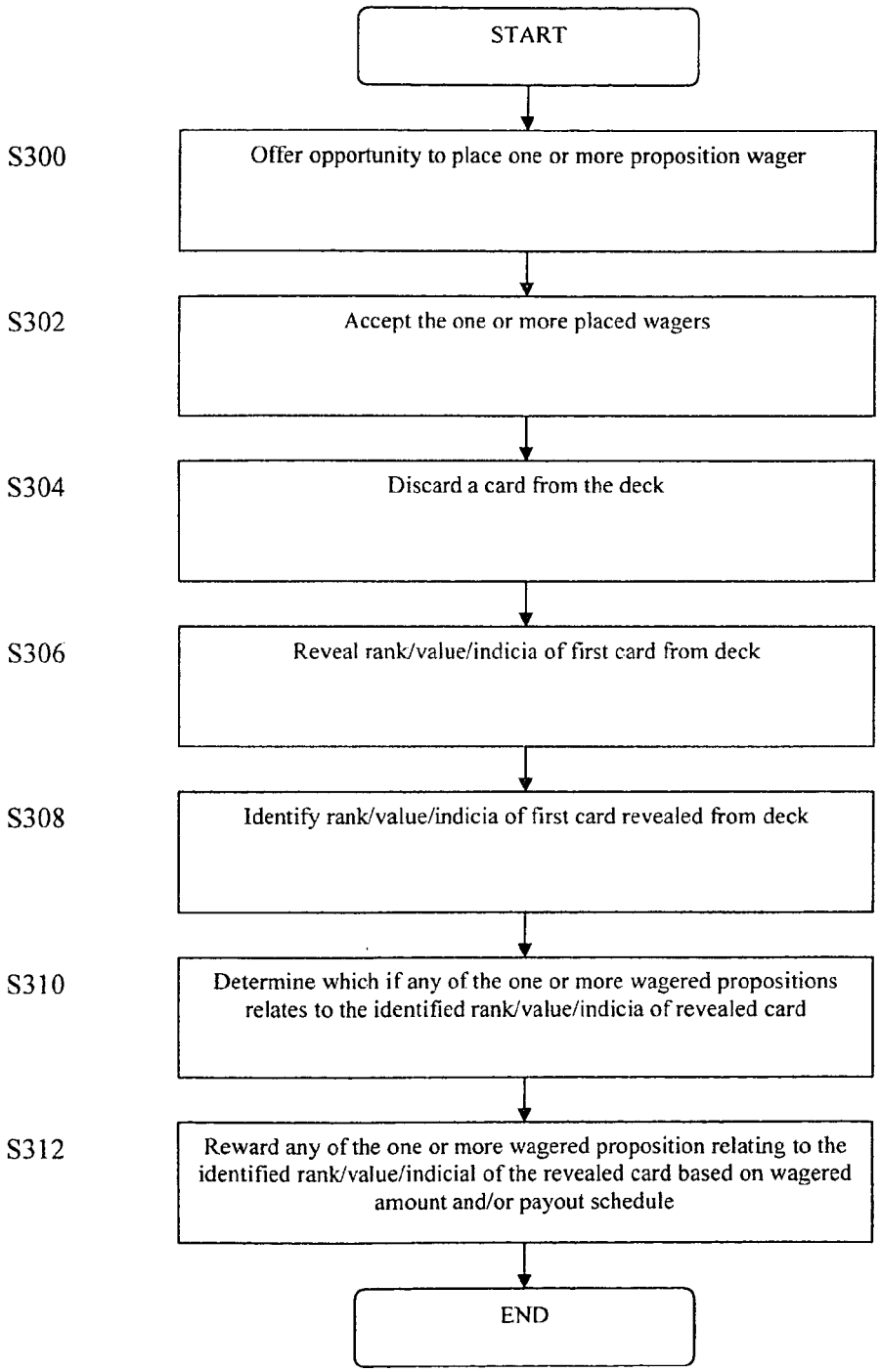
FIG. 3 is a flow chart of the play of the card game system according to the first embodiment.

Referring now to FIG. 3, a flow chart of the play of the card game system 100 is provided. Play of the card game system 100 begins at step S300 by offering at least one player an opportunity to place one or more proposition wagers on game surface 102. At step S302, the one or more wagers from the at least one player is then accepted. At step S304, a random card from the above-described 36-card deck is discarded. At step S306, the rank/value/indicia of a first card (FIG. 1*b*, reference numeral 116) from the cards remaining in the 36-card deck of cards is then revealed. At step 308, the rank/value/indicia of the revealed card is identified. At step 310, a determination is made as to which, if any, of the one or more wagered propositions matches the identified rank/value/indicia of the revealed card. At step 312, each of the one or more wagered propositions matching the identified rank/value/indicia of the revealed card is then rewarded based on the wagered amount and/or payout schedule.

As a variation on the first embodiment, the game can be played without the necessity of gambling. For example, the card game system can be adapted for in-home play which includes all the features of the above-described card game system but with no money payout.

A second embodiment, described below, is directed to the implementation of the card game described in the first embodiment, preferably as an electronic gaming machine.

The operation of electronic gaming machines are well known in the art such that minute details are not set forth herein. In general terms, electronic gaming machines are controlled by processors including, or in communication with, a random number generator. The random number generator generates the machine's outcomes. A display in communication with the processor provides visual information to players. The gaming machine further includes a user interface in the form of player buttons, touch-screen technology, or the like to facilitate the interface between one or more players and the machine processor.

The electronic gaming machine of the second embodiment includes a means of representing at least one deck of the above-described 36-card deck of cards. The electronic gaming machine further includes a means of randomly selecting one card from the representation of the 36-card deck of cards.

Figure 4A:
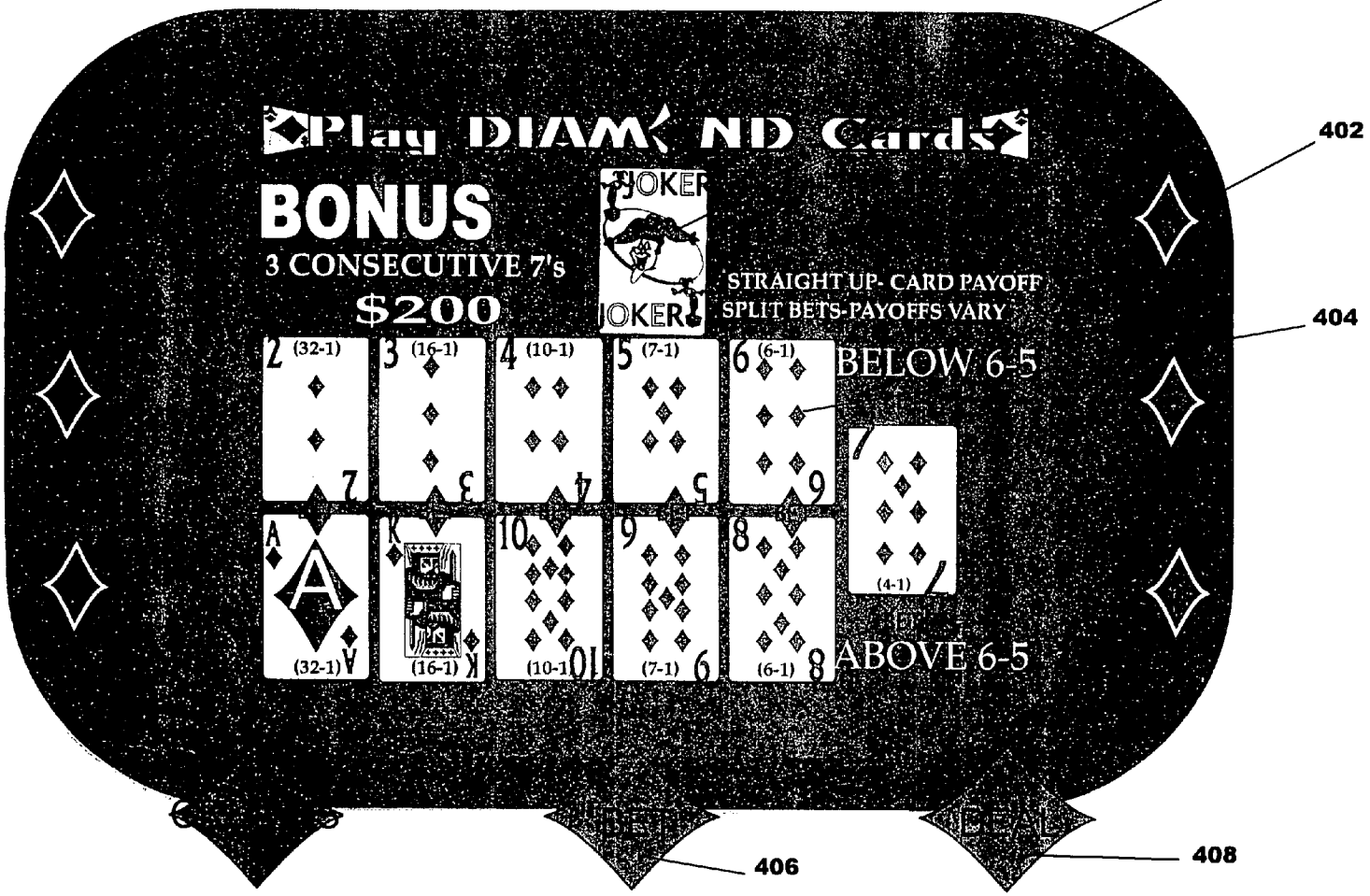
FIGS. 4*a* and 4*b* illustrate an electronic gaming machine according to a second embodiment.
Figure 4B:
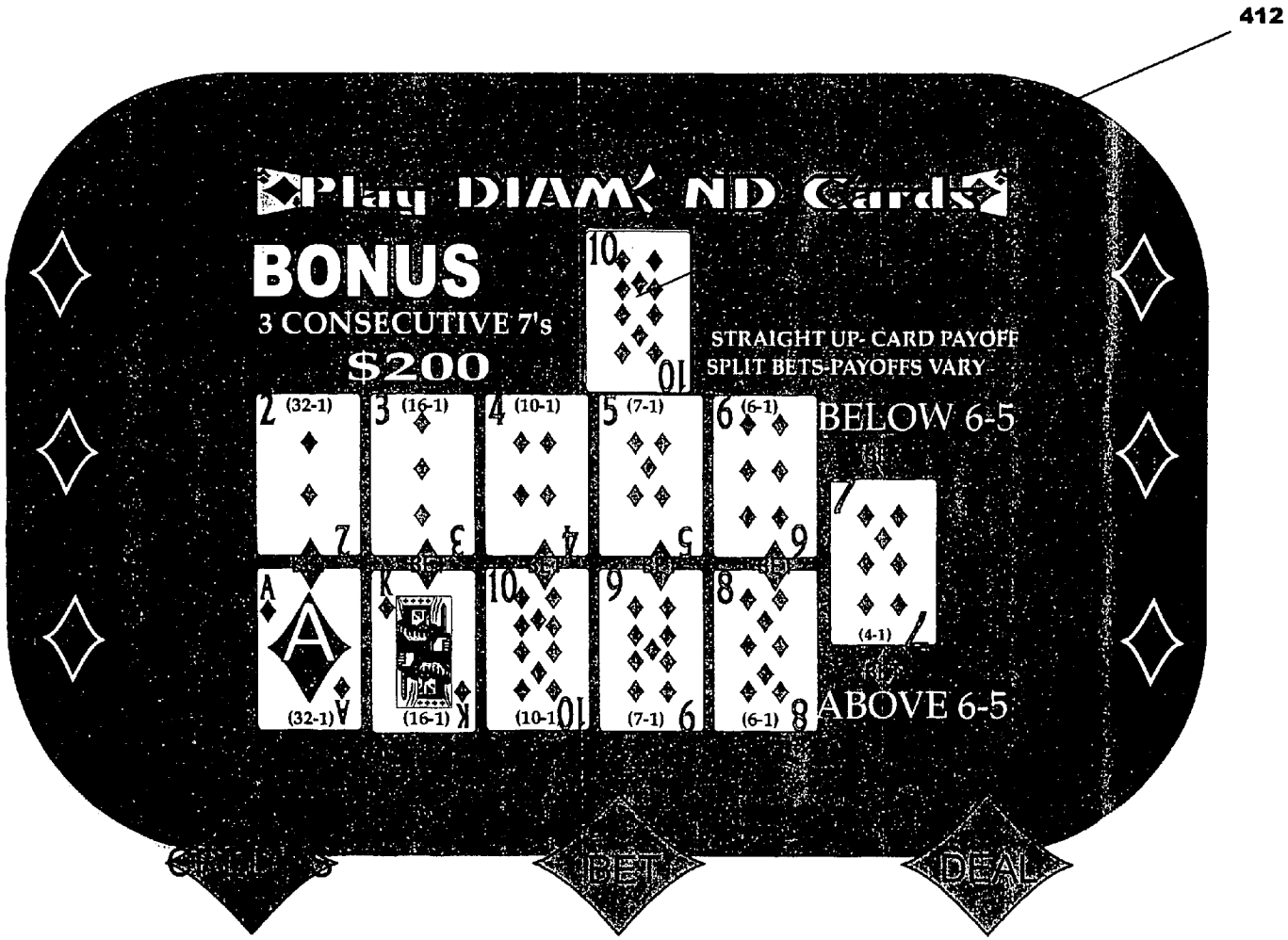

The electronic gaming machine further includes a display/user interface 402, as illustrated in FIGS. 4*a* and 4*b*. Display/user interface 402 and indicia 404 therein are substantially similar to the game surface 102 and indicia 104 described in the first embodiment.

User interface 402 is utilized by one or more players to place one or more proposition wagers relating to the value of a card to be randomly selected from the representation of the 36-card deck of cards. As an example, a user interface device (not shown) such as a mouse can be used to click a "BET" button 406 on display/user interface 402 to indicate the intention to place a proposition wager. After clicking on "BET" button 406, placement of a proposition wager can be made with the user interface device in a manner similar to the placement of proposition wagers on game surface 102 in the first embodiment.

Referring now to FIG. 4*b*, upon completing the placement of all proposition wagers, a player then utilizes the user interface device to click on a "DEAL" button 408 to command the random selection of one card from the representation of the 36-card deck of cards and the display of the selected card as a virtual card 412 in area 410 on display/user interface 402.

The processor of the electronic gaming machine then determines which, if any, of the one or more wagered propositions match the rank/value/indicia of the revealed virtual card. Each of the one or more wagered propositions matching the identified rank/value/indicia of the revealed card is then rewarded based on the wagered amount and/or a predetermined payout schedule.

In addition, the second embodiment can be readily implemented as a computer program product (e.g., floppy disk, compact disc, etc.) comprising a computer readable medium having controlled logic recorded therein to implement the features of the invention as described in relation to the invention embodiments. Control logic can be loaded into the memory or a computer and executed by a central processing unit (CPU) to perform the operations described herein.

Figure 5:
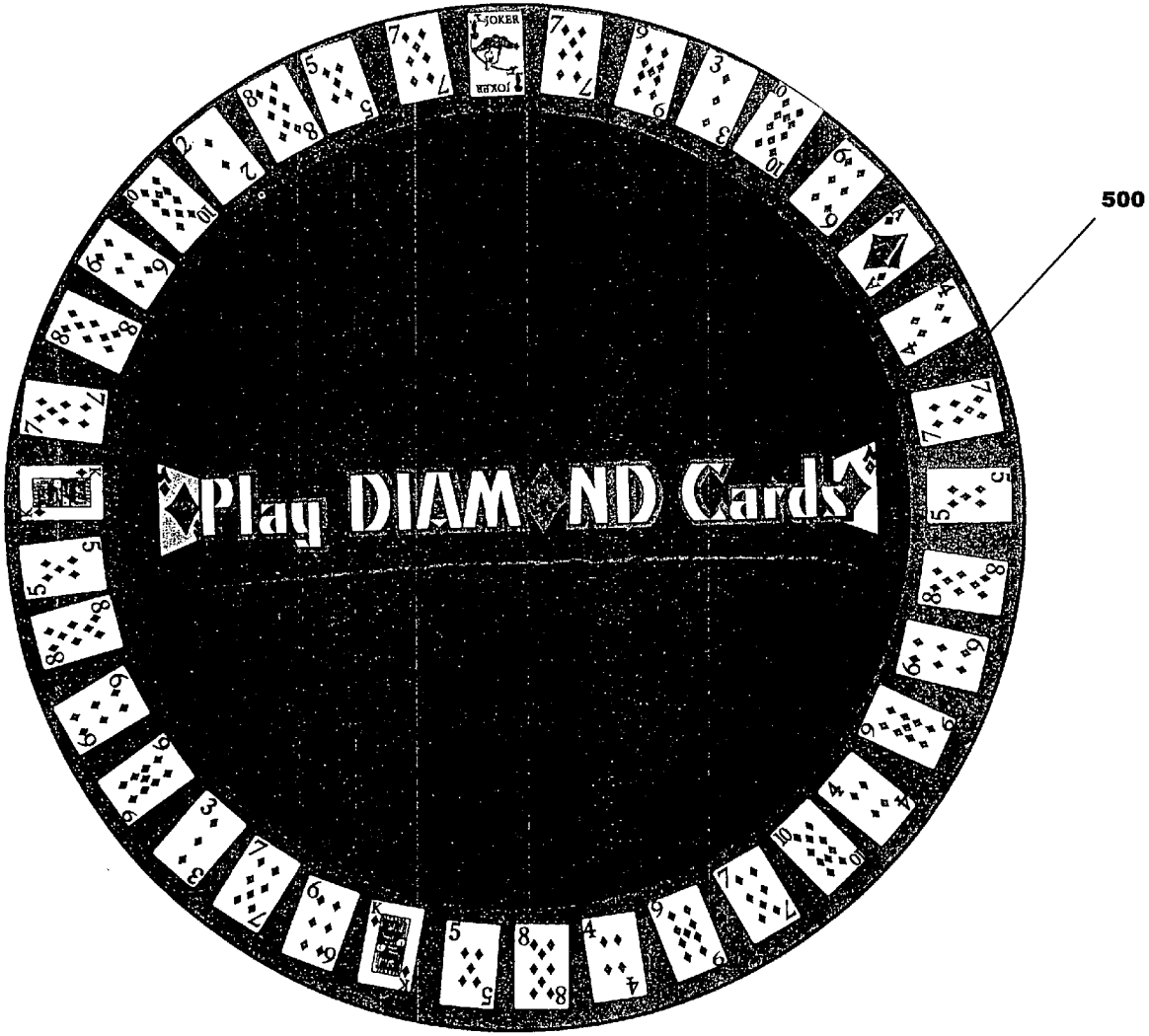
FIG. 5 illustrates a roulette-type game system and a giant wheel-type game system according to a third and fourth embodiment, respectively.

A third and fourth embodiment will be described with reference to FIG. 5.

A third embodiment to be described is directed to the implementation of the card game described in the first embodiment, preferably as a roulette-type game system.

The third embodiment is substantially the same as the first embodiment in that the roulette-type game system has a game surface that is substantially the same as the one described in the first embodiment.

Instead of utilizing a 36-card deck of cards as described in the first embodiment, the third embodiment includes a displayed roulette wheel 500. The structure of a roulette wheel is well known in the art such that minute details are not set forth herein. The wheel 500 includes a base and a rotatable upper portion which rotates relative to the base. The upper rotatable portion has thirty-six slots. Each of the thirty-six slots corresponds to a card value/rank/indicia from the above-described thirty-six card deck. The wheel 500 also has means for retaining and directing a rolled ball such that the rolled ball comes to a rest in one of the plurality of slots. The means for retaining and directing the rolled ball are well known in the art and only a brief description is therefore presented. Generally, the wheel 500 includes an open annular slot in which the ball is rolled. Upon losing velocity, the ball falls into the region of the wheel 500 containing the slots, eventually coming to rest in one of the plurality of slots.

The above-described roulette wheel 500 is operated to reveal the value/rank/indicium corresponding to a "first card" from the 36-card deck of cards described in the first embodiment.

As a variation of the third embodiment, a roulette wheel also has a slot corresponding to a zero (or a "Joker"). In activating the roulette wheel, if a rolled ball falls into the zero/Joker slot, no winning value/rank/indicium is determined and a subsequent spin of the roulette wheel is required. The roulette wheel is operated until a non-zero value/indicium is revealed.

A fourth embodiment to be described is directed to the implementation of the card game described in the first embodiment, preferably as a giant wheel-type game system.

The fourth embodiment is substantially the same as the first embodiment in that the giant wheel-type game apparatus has a game surface that is substantially the same as the one described in the first embodiment.

Instead of the 36-card deck described in the first embodiment, the fourth embodiment includes a displayed card wheel 500 having thirty-six segments corresponding to each card in the above-described 36-card deck.

In the fourth embodiment, play of the game is substantially the same as described in the first embodiment. However, instead of dispensing/revealing a random card from a 36-card deck, the card wheel 500 is operated to randomly select a segment corresponding to a card randomly drawn from a 36-card deck of cards.

Figure 6A:
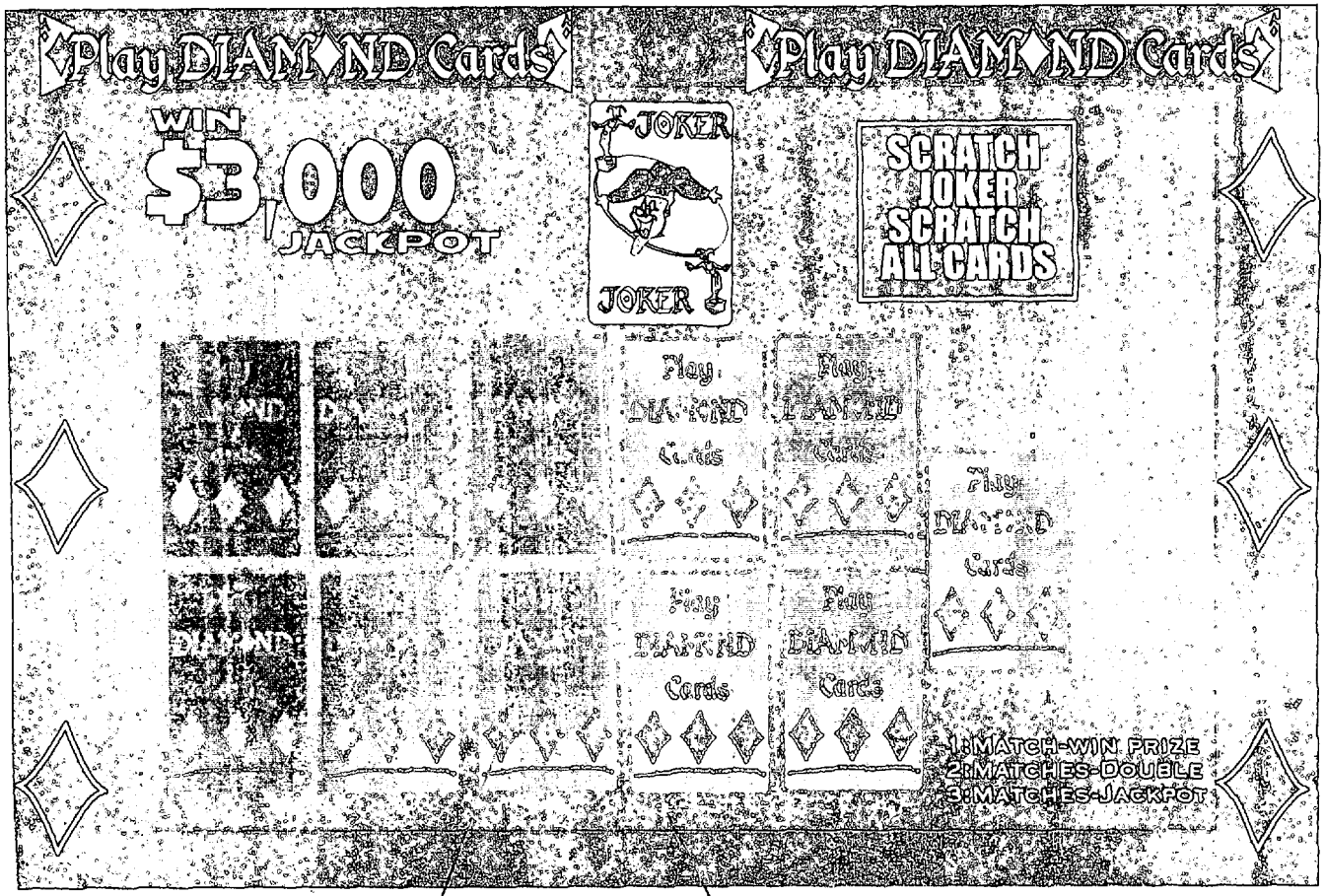
FIGS. 6*a* and 6*b* illustrate a scratch-off card game according to a fifth embodiment.
Figure 6B:
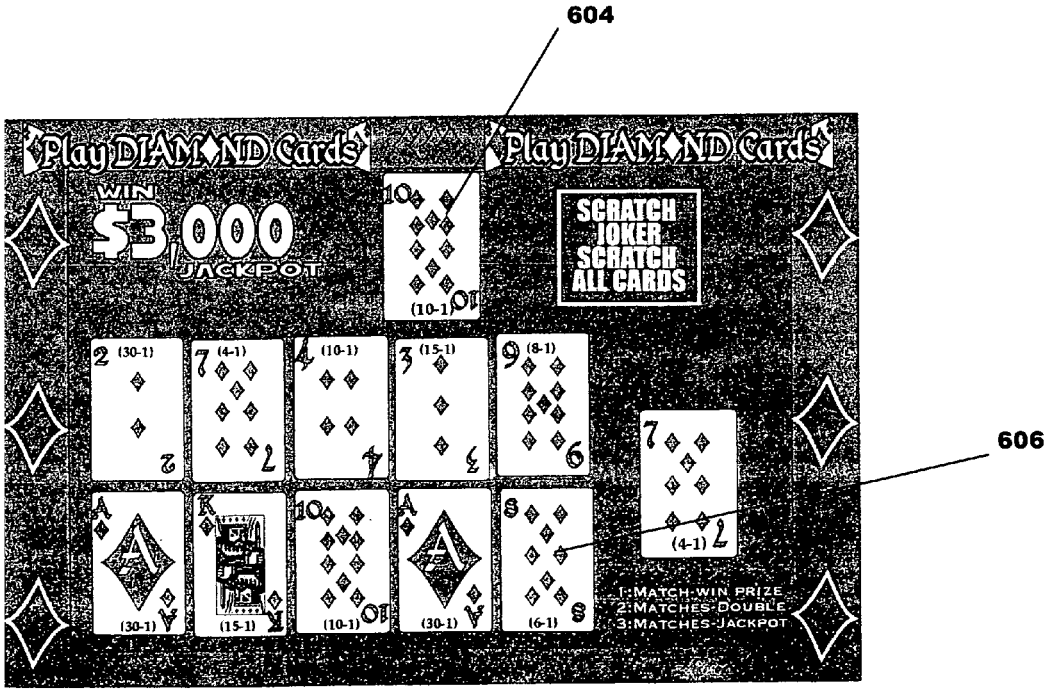

Referring now to FIGS. 6*a* and 6*b*, a scratch-off card game, as a fifth embodiment, is shown herein. The scratch-off card game is referred to generally by reference numeral 600.

The scratch-off card game 600 includes a substrate 602 with a winning indicium 604 and eleven gaming indicia 606 imparted thereon. Each of the winning indicium 604 and eleven gaming indicia 606 is covered by a removable covering material 608. The removable covering material 608 is removable by scratching, abrasion, or other similar actions.

winning card indicium 604 is one of thirty-six possible game card indicia, the thirty-six game card indicia includes (a) one indicium of a first value, (b) two indicia of a second value, (c) three indicia of a third value, (d) four indicia of a fourth value, (e) five indicia of a fifth value, (f) six indicia of a sixth value, (g) five indicia of a seventh value, (h) four indicia of an eighth value, (i) three indicia of a ninth value, (j) two indicia of a tenth value, and (k) one indicium of an eleventh value.

The eleven playing card indicia 608 includes eleven indicia randomly selected from the above-described thirty-six possible game card indicia.

Play of the card game 600 begins with the removal of the covering material 608 covering each of the winning card indicium 604 and the eleven gaming indicia 606. The revealed value of the winning card indicium 604 is then compared to each of the values of the exposed eleven gaming indicia 606. A determination is then made as to whether any of the values of the exposed eleven gaming indicia 606 matches the value of the revealed winning indicium 604. A reward based on the purchase price of the card game 600 and/or a predetermined payout schedule can be made for a substrate 602 with one or more matching gaming indicia.

As would be apparent to those skilled in the relevant art, the invention can also be embodied in a wide variety and forms of media such as, but not limited to, home casino type games, single player video machines, multi-player video machines, lottery terminals (including video lottery terminal VLT machines), telephone games, television games, as well as Internet entertainment.

It is therefore intended that the invention be not limited to the exact forms described and illustrated, but should be constructed to cover all modifications that may fall within the scope of the appended claims.

What is claimed is:

1. A system for playing a card game, the system comprising:

a processor configured to control a display to display a layout for indicating at least one proposition related to the value of a single card to be selected from a representation of a deck of thirty-six cards comprising: (a) one card showing a first indicium representing a first value, (b) two cards each showing a second indicium representing a second value, (c) three cards each showing a third indicium representing a third value, (d) four cards each showing a fourth indicium representing a fourth value, (e) five cards each showing a fifth indicium representing a fifth value, (f) six cards each showing a sixth indicium representing a sixth value, (g) five cards each showing a seventh indicium representing a seventh value, (h) four cards each showing an eighth indicium representing an eighth value, (i) three cards each showing a ninth indicium representing a ninth value, (j) two cards each showing a tenth indicium representing a tenth value, and (k) one card showing an eleventh indicium representing an eleventh value;

a user interface configured to accept, with reference to the layout, at least one proposition related to the value of a single card to be selected from the representation of the deck of thirty-six cards;

the processor being further configured to randomly select a single card from the representation of the deck of thirty-six cards, and to determine whether any of the at least one proposition accepted by the user interface relates to the value of the randomly selected single card from the representation of the deck of thirty-six cards, wherein a proposition is at least one of:

that a value indicated by the accepted proposition is the same as the value of the single card selected from the representation of the deck of thirty-six cards;

that the single card selected from the representation of the deck of thirty-six cards has a value that is one of either the first or eleventh value, either the second or tenth value, either the third or ninth value, either the fourth or eighth value, and either the fifth or seventh value, as indicated by the accepted proposition; and that the value of the single card selected from the representation of the deck of thirty-six cards is one of a value ranking lower than the sixth value or ranking higher than the sixth value, as indicated by the proposition, wherein the first to fifth values are assigned a lower rank than the sixth value and the seventh to eleventh values are assigned a higher rank than the sixth value.

2. The system for playing a card game of claim 1, wherein the layout includes the first to eleventh indicium.

3. The system for playing a card game of claim 1, wherein the user interface is further configured to accept a wager for each of the at least one accepted proposition related to the value of the single card to be selected from the representation of the deck of thirty-six cards.

4. The system for playing a card game of claim 3, wherein the processor is further configured to determine a reward for a winning wager for an accepted proposition that relates to the value of the single card selected from the representation of the deck of thirty-six cards.

5. The system for playing a card game of claim 4, wherein the processor is further configured to determine the reward for the winning wager according to a pre-determined payout schedule.

6. A method for playing a game, the method including:

a user interface accepting at least one proposition related to the value of a single card to be selected from a representation of a deck of thirty-six cards, the representation of a deck of thirty-six cards comprising: (a) one card showing a first indicium representing a first value, (b) two cards each showing a second indicium representing a second value, (c) three cards each showing a third indicium representing a third value, (d) four cards each showing a fourth indicium representing a fourth value, (e) five cards each showing a fifth indicium representing a fifth value, (f) six cards each showing a sixth indicium representing a sixth value, (g) five cards each showing a seventh indicium representing a seventh value, (h) four cards each showing an eighth indicium representing an eighth value, (i) three cards each showing a ninth indicium representing a ninth value, (j) two cards each showing a tenth indicium representing a tenth value, and (k) one card each showing an eleventh indicium representing an eleventh value;

a processor randomly selecting a single card from the representation of the deck of thirty-six cards; and the processor determining whether any of the at least one accepted proposition relates to the value of the single card selected from the representation of the deck of thirty-six cards, wherein a proposition accepted by the user interface is one of:

that a value indicated by the accepted proposition is the same as the value of the single card selected from the representation of the deck of thirty-six cards;

that the single card selected from the representation of the deck of thirty-six cards has a value that is one of either the first or eleventh value, either the second or tenth value, either the third or ninth value, either the fourth or eighth value, and either the fifth or seventh value, as indicated by the accepted proposition; and that the value of the single card selected from the representation of the deck of thirty-six cards is one of a value ranking lower than the sixth value or ranking higher than the sixth value, as indicated by the accepted proposition, wherein the first to fifth values are assigned a lower rank than the sixth value and the seventh to eleventh values are assigned a higher rank than the sixth value.

7. The method of claim 6, the method further including the user interface accepting a wager for each of the accepted at least one proposition related to the value of the single card to be selected from the representation of the deck of thirty-six cards.

8. The method of claim 7, the method further including rewarding any winning wager for each accepted proposition related to the value of the single card to be selected from the representation of the deck of thirty-six cards.

9. The method of claim 8, wherein the rewarding of a winning wager is made according to a payout schedule.

10. The method of claim 6, the method further including the user interface accepting an elective proposition that three repetitions of randomly selecting a single card from the representation of the deck of thirty-six cards will reveal, in each repetition, a card having the sixth value.

11. The method of claim 7, wherein the method further includes playing the game as a virtual game on a computer.

* * * * *